US008646486B2

(12) United States Patent
Schommer

(10) Patent No.: US 8,646,486 B2
(45) Date of Patent: Feb. 11, 2014

(54) ELLIPTICAL CHAMBERED FLOW RESTRICTOR

(75) Inventor: John Schommer, New River, AZ (US)

(73) Assignee: Watermiser, LLC., Encinitas, CA (US)

( * ) Notice: Subject to any disclaimer, the term of this patent is extended or adjusted under 35 U.S.C. 154(b) by 0 days.

(21) Appl. No.: 13/570,197

(22) Filed: Aug. 8, 2012

(65) Prior Publication Data

US 2013/0037153 A1 Feb. 14, 2013

Related U.S. Application Data

(60) Provisional application No. 61/523,358, filed on Aug. 14, 2011.

(51) Int. Cl.
*F15D 1/04* (2006.01)

(52) U.S. Cl.
USPC ..... 138/44; 138/40; 73/861.63

(58) Field of Classification Search
USPC ..... 138/40, 44, 45
See application file for complete search history.

(56) References Cited

U.S. PATENT DOCUMENTS

| | | | | |
|---|---|---|---|---|
| 1,662,374 | A | 3/1928 | Woodmansee | |
| 1,744,842 | A * | 1/1930 | Suverkrop et al. | 138/44 |
| 2,127,501 | A * | 8/1938 | Dall | 73/861.61 |
| 2,190,357 | A * | 2/1940 | Ginter | 285/9.2 |
| 2,271,982 | A | 2/1942 | Van Kreveld | |
| 2,456,626 | A * | 12/1948 | Dahnke | 138/44 |
| 2,842,962 | A * | 7/1958 | Dall | 73/861.61 |
| 2,939,487 | A | 6/1960 | Fraser et al. | |
| 2,975,478 | A | 3/1961 | Finster | |
| 3,111,091 | A * | 11/1963 | Hopkinson | 417/186 |
| 3,145,529 | A * | 8/1964 | Maloof | 428/569 |
| 3,687,493 | A * | 8/1972 | Lock et al. | 285/333 |
| 3,702,144 | A * | 11/1972 | Loveland | 138/44 |
| 3,894,562 | A * | 7/1975 | Moseley et al. | 138/44 |
| 3,999,714 | A | 12/1976 | Lang | |
| 4,168,725 | A * | 9/1979 | Astakhov et al. | 138/44 |
| 4,782,861 | A | 11/1988 | Ross | |
| 5,178,325 | A | 1/1993 | Nielsen | |
| 5,184,641 | A | 2/1993 | Kuhn | |
| 5,209,265 | A | 5/1993 | Taguri et al. | |

(Continued)

FOREIGN PATENT DOCUMENTS

| | | | |
|---|---|---|---|
| CH | 199135 | A | 8/1938 |
| EP | 0482904 | A1 | 4/1992 |
| GB | 1404857 | A | 9/1975 |
| RU | 1734442 | | 1/1995 |

(Continued)

OTHER PUBLICATIONS

International Search Report and Written Opinion dated Nov. 1, 2012 for PCT Application No. PCT/US2012/050035.

*Primary Examiner* — Patrick F Brinson

(74) *Attorney, Agent, or Firm* — The Mueller Law Office, P.C.

(57) ABSTRACT

This invention sets forth a water flow restrictor for insertion into a water line connected to a water dispensing fixture. The restrictor includes an in-line restrictor body having a longitudinal flow passageway. The body also has an upstream coupling and a downstream coupling so that the body can be coupled into a water line. The body further has an upstream water receiving chamber and a downstream water passing chamber. An orifice of selectable restrictive size is located between the chambers. The orifice limits the flow of water through the passageway. The upstream water receiving chamber has an elliptically converging interior configuration approaching the orifice.

20 Claims, 9 Drawing Sheets

(56) References Cited

U.S. PATENT DOCUMENTS

| | | | | |
|---|---|---|---|---|
| 5,315,859 | A | 5/1994 | Schommer | |
| 5,868,325 | A | 2/1999 | Tassinari | |
| 2009/0065061 | A1* | 3/2009 | Bell | 137/1 |

FOREIGN PATENT DOCUMENTS

| | | | |
|---|---|---|---|
| RU | 2232328 | C2 | 7/2004 |
| RU | 2338944 | C2 | 11/2008 |
| SU | 338728 | A1 | 5/1972 |

* cited by examiner

SECTION A-A

SECTION C-C

DETAIL B

SECTION A-A

SECTION C-C

DETAIL B

SECTION A-A

SECTION C-C

DETAIL B

SECTION A-A

SECTION C-C

DETAIL B

ELLIPTICAL CHAMBERED FLOW RESTRICTOR

RELATED APPLICATION

This application claims priority to U.S. Provisional Patent Application No. 61/523,358, filed on Aug. 14, 2011, entitled "Elliptical Chambered Flow Restrictor," which is hereby incorporated by reference for all purposes.

BACKGROUND

Water conservation plays an important role in today's society. Efficiently managing water resources helps to save usable water, reduce energy consumption, and decrease sewage costs. Past and current efforts to conserve water resources have been varied. Residential, commercial, and industrial plumbing infrastructure, for example, incorporates technological advances aimed at decreasing water usage, utilizing efficient energy transfer, and re-use techniques. However, many technological designs fail to appreciate end-use concerns. Some end-use concerns involve consumers in residential environments, where designs for use with faucets and showers provide some improvements in water conservation, but usually at the expense of consumer expectations such as water pressure and desired flow rate.

One example of a device used in faucets and showers is a flow control valve which can alter the flow of water passing through the plumbing by restricting the water flow, in an effort to decrease water output at a use point while maintaining water pressure. Such a device can incorporate a hemispherical water input chamber which restricts water flow during passage of the water through an internal pass-through opening of the device to a hemispherical water output chamber, thereby decreasing water output while still attempting to minimize water pressure losses through the line. Such flow control devices provide low flow, but can be at the expense of rinsability factors, including water pressure and flow rate.

Another example of a device used in faucets is a water flow limiting device that slidably attaches to a faucet. This type of device includes a cylindrical section surrounding the faucet that reduces in diameter to form a conical, spherical or elliptical portion exiting the device. Such a device reduces flow rate and provides an exit jet of water.

Another example of a device used in showers is a water flow assembly for controlling a flow of fluid through the device. The flow of fluid within and exiting the device can be controlled using a device configuration that imparts rotation into the flow of fluid. The rotation may help to create unstable, turbulent flow in the flow of fluid.

Another example of a flow restrictor device is a spray nozzle for concentrating flow through an elongated orifice passageway. The spray nozzle itself is comprised of an elongated orifice passageway with a length sufficiently long in relation to the equivalent diameter so as to reduce the average spray velocity of a fluid exiting the device. Such a device may contain a passageway that is a hollow dome-shaped chamber centered about the flow axis of the device. An exit orifice of this device may have an elliptical, circular, or similarly shaped cross-section.

Another example of a flow restrictor device is a housing for connection in a water flow path that contains a spherical restrictor body and a restrictor member disposed in the flow path to define a restriction, such that fluid flow through the device is restricted.

However, there continues to be a demand for novel features and developments in water conservation devices in the efforts to manage water resources in a socially, economically, and environmentally responsible manner, while still accommodating the desires of the end-user.

BRIEF SUMMARY OF THE INVENTION

The present invention sets forth a water flow restrictor for insertion into a water line connected to a water dispensing fixture. The restrictor includes an in-line restrictor body having a longitudinal flow passageway. The body also has an upstream coupling and a downstream coupling so that the body can be coupled into a water line. The body further has an upstream water receiving chamber and a downstream water passing chamber. An orifice of selectable restrictive size is located between the chambers. The orifice limits the flow of water through the passageway. The upstream water receiving chamber has an elliptically converging interior configuration approaching the orifice.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE EMBODIMENTS

Figure 1A:
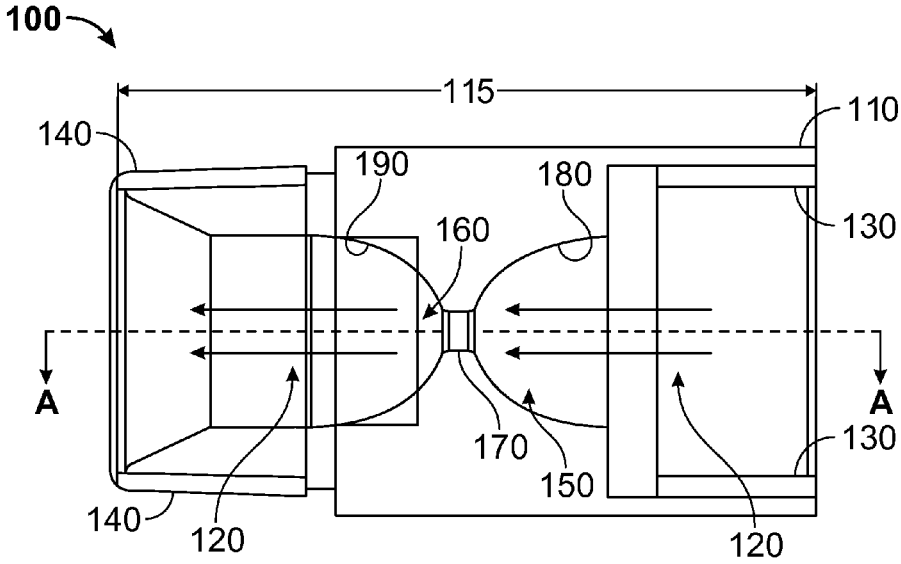
FIG. 1*a* provides an interior view of an embodiment of a flow restrictor of the present invention.

FIG. 1*a* provides an interior view of an embodiment of a flow restrictor 100 according to the present invention. Flow restrictor 100 includes an in-line restrictor body 110. In-line restrictor body 110 can be made of metal, plastic, or any material suitable for accepting various types of fluids, and these fluids may have different properties. Example materials for in-line restrictor body 110 include stainless steel, no-lead brass, aluminum, copper, polyvinyl chloride (PVC) or other polymer-based material, or a composite material.

In-line restrictor body 110 includes a passageway 120 for longitudinal fluid flow. Any fluid may be used with the present invention, with reference made to water throughout for illustrative purposes. In-line restrictor body 110 also includes upstream coupling 130 and downstream coupling 140 for coupling restrictor body 110 into a water line (not pictured). Upstream coupling 130 and downstream coupling 140 may include threads for coupling restrictor body 110 into a water line. Upstream coupling 130 and downstream coupling 140 can also be any other design suitable for coupling restrictor body 110 into a water line.

In-line restrictor body 110 further includes an upstream water receiving chamber 150 and a downstream water passing chamber 160. Although referenced using upstream and downstream, a flow restrictor according to the present invention may be inserted in a horizontal configuration.

In addition, flow restrictor 100 may be positioned bi-directionally and may therefore be used in a reversed stream arrangement. The bi-directional, reversible feature also enables simple and efficient installation of the device in a water line, by eliminating the need for a specific alignment and reducing labor costs for installation.

An orifice 170 within restrictor body 110 limits the flow of water through passageway 120. Any selectable restrictive size may be used for the design of orifice 170. The selectable restrictive size and design of orifice 170 may be of circular/cylindrical or elliptical/cylindrical proportions. The orifice length 195 (as shown in FIG. 1*e*) may be any selectable length. For example, the orifice length may be 0.062 inches. All references provided herein to example values are approximate values within ±30 percent.

The orifice size chosen to restrict the flow of water can be selected based on the water pressure through the water line to achieve a desired gallons-per-minute (GPM) flow rate. Selection of the orifice size based on water pressure and desired flow rate helps to maintain a specific water pressure (generally described using the terminology pounds per square inch or psi), while restricting or minimizing flow rate. For example, the orifice size may be selected for a given water pressure, such that a desired flow rate exiting the orifice may be achieved. The reduced flow rate at or near a point of use allows for properly maintained water pressure and distribution through a system of water lines while reducing water consumption. This provides advantages over a water pressure regulation system whereby water pressure is decreased to reduce water consumption.

To illustrate selection of the orifice size, for a water pressure of 60-80 psi, for example, and a GPM flow rate ranging from about 0.50 to about 5.0, for example, an orifice size may be selected, which may range from about 0.059 inches to about 0.191 inches, for example. Table A provides examples of selection of the orifice size. For example, at a water pressure of 60-80 psi and a desired flow rate of 0.75 GPM, an orifice size of 0.073 inches in diameter may be selected. For further example, at a water pressure of 60-80 psi and a desired flow rate of 0.75 GPM, an orifice size of 0.073 inches in diameter of a major axis of an ellipse may be selected.

TABLE A

Selection of Orifice Size Based on Desired Flow Rate at a Given Water Pressure

| Water Pressure (psi) | Desired Flow Rate (GPM) | Orifice Size (inches) |
|---|---|---|
| 60-80 | 0.50 | 0.059 |
| 60-80 | 0.75 | 0.073 |

TABLE A-continued

Selection of Orifice Size Based on Desired Flow Rate at a Given Water Pressure

| Water Pressure (psi) | Desired Flow Rate (GPM) | Orifice Size (inches) |
|---|---|---|
| 60-80 | 1.00 | 0.086 |
| 60-80 | 1.25 | 0.089 |
| 60-80 | 1.50 | 0.096 |
| 60-80 | 1.75 | 0.104 |
| 60-80 | 2.00 | 0.113 |
| 60-80 | 2.25 | 0.120 |
| 60-80 | 2.50 | 0.128 |
| 60-80 | 2.75 | 0.136 |
| 60-80 | 3.00 | 0.147 |
| 60-80 | 3.25 | 0.152 |
| 60-80 | 3.50 | 0.154 |
| 60-80 | 3.75 | 0.161 |
| 60-80 | 4.00 | 0.173 |
| 60-80 | 4.25 | 0.177 |
| 60-80 | 4.50 | 0.182 |
| 60-80 | 4.75 | 0.185 |
| 60-80 | 5.00 | 0.191 |

Returning to the upstream water receiving chamber 150, this upstream water receiving chamber 150 uses an elliptical configuration, which converges in an elliptical shape as upstream water receiving chamber 150 approaches orifice 170. This elliptically converging interior configuration 180 provides several significant results. For example, particulate matter, including aggregated mineral-based particulates such as freed calcium deposits and other particulates such as rust flakes from iron piping, can create problems such as clogging and build-up in restricted aperture, fluid flow devices. The elliptically converging interior configuration 180 of upstream water receiving chamber 150 can create and accommodate substantially turbulent fluid flow in upstream water receiving chamber 150, which assists with dissolving particulate matter through a washing and tumbling mechanism, while simultaneously assisting with the prevention of particulate matter from becoming lodged in orifice 170.

The water entering the upstream water receiving chamber 150 is directed into an area of maximum turbulence as it approaches orifice 170. This area of maximum turbulence keeps the water tumbling and scrubbing the interior of the upstream water receiving chamber 150. The scrubbing action may be aided by particulate matter, such that the upstream water receiving chamber 150 is abrasively scrubbed, thereby keeping the upstream water receiving chamber 150 and orifice 170 free from debris and build-up.

In addition, the elliptical design of the upstream water receiving chamber 150 provides for a larger volume of water to be subject to turbulent flow. The volume can be increased further by using an elongated elliptical design or ellipse profiles of varying dimensions. Example ellipse profiles are discussed further herein in relation to the figures and tables provided. These aforementioned attributes of the elliptical configuration of the upstream water receiving chamber 150 assist with providing a self-cleaning, non-clogging device.

Flow restrictor 100 also helps regulate water flow to achieve a desired gallons-per-minute flow rate through the device, without requiring the use of additional devices such as aerators. The elimination of the need for additional devices to control flow, such as aerators, provides added utility to flow restrictor 100. For example, aerators, such as those located on faucet spouts, can be a source of non-sterility in facilities such as hospitals. By eliminating the need for additional devices such as aerators, water dispensing fixtures in hospitals can eliminate a potentially dangerous source of contamination. Furthermore, there are reduced costs from the elimination of additional devices such as aerators in hospitals, because this eliminates the need to clean and/or sterilize the aerators through procedures such as autoclaving and also eliminates the need to replace broken or missing aerators. In addition, hospitals may have regulations that require devices such as aerators to not be used in the facility, for sterility concerns or other reasons. Finally, the elimination of aerators and other devices is a cost savings in any application.

Turning now to downstream water passing chamber 160 having exit chamber length 197 (as shown in FIG. 1*e*), this downstream water passing chamber 160 may also use an elliptical design, which diverges interiorly in an elliptical manner from orifice 170. Downstream water passing chamber 160 incorporates this elliptically diverging interior configuration 190 departing from orifice 170 and provides additional useful functionality. The water flow from upstream water receiving chamber 150 flows through orifice 170 into downstream water passing chamber 160. The turbulent fluid flow in upstream water receiving chamber 150 exits orifice 170, of selectable restrictive size, in a substantially non-turbulent water flow. Thus, turbulent water flow can be minimized through passageway 120 and the water flow passing into the downstream water passing chamber 160 can be substantially non-turbulent.

The design of upstream water receiving chamber 150 and downstream water passing chamber 160, in connection with the additional elements of flow restrictor 100, reduces flow rate while helping to maintain the water pressure and desired gallons-per-minute flow rate for accommodating the desires of the end-user of such a device. Thus, by inserting the flow restrictor 100 into a water line connected to a water dispensing fixture, flow restrictor 100 can be used upstream of the water dispensing fixture to regulate water flow through the line and out the water dispensing fixture.

Figure 1B:
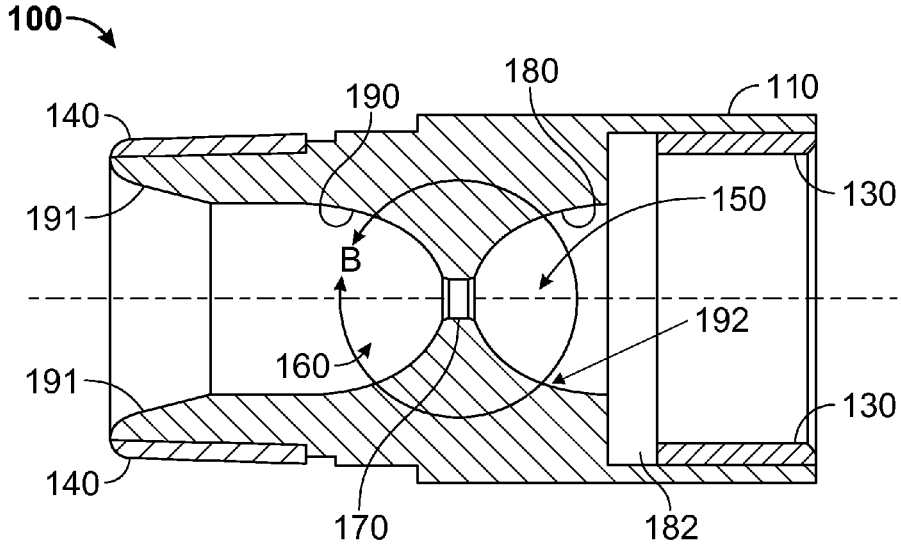
FIG. 1*b* depicts a cross-sectional view of the flow restrictor of FIG. 1*a* taken along the line A-A shown in FIG. 1*a;*

FIG. 1*b* depicts a cross-sectional view of flow restrictor 100 of FIG. 1*a* taken along the line A-A. FIG. 1*b* illustrates additional design elements of flow restrictor 100. For example, the downstream end of in-line restrictor body 110 can optionally use a chamfered interior design 191 to align with a water line. The chamfered interior design 191 can be chamfered at any angle. For example, the chamfered interior design 191 can be chamfered at an angle of fifteen (15) degrees. Further, seal 182 can optionally be placed within the upstream end of in-line restrictor body 110 for sealing engagement of a water line. Seal 182 can be an O-ring, washer, or other device for sealing engagement. Seal 182 can be made of any material suitable for the properties of the fluid in the line.

Figure 1C:
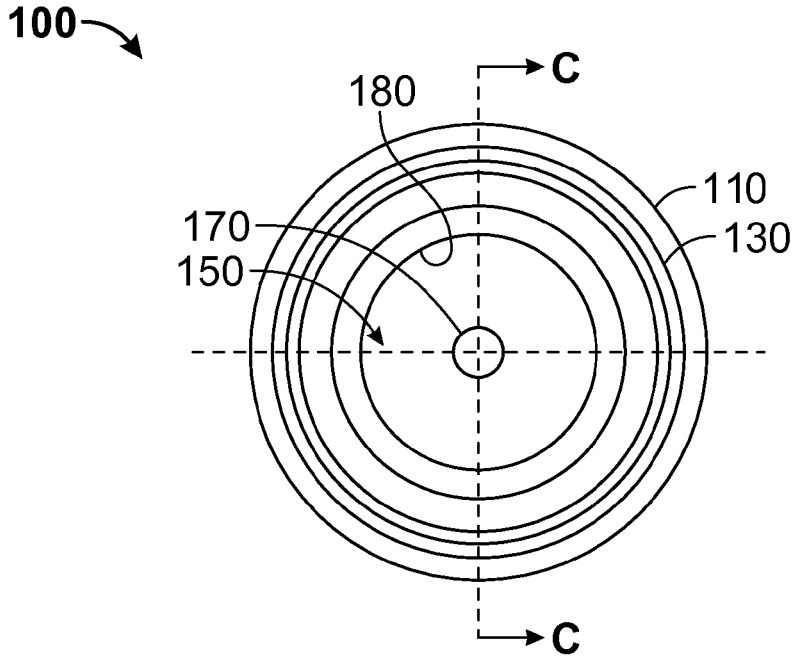
FIG. 1*c* illustrates a top view of the flow restrictor of FIG. 1*a;*

FIG. 1*c* illustrates a perspective, top view of the upstream end of flow restrictor 100 of FIG. 1*a*. FIG. 1*c* includes references to previously described features of flow restrictor 100.

Figure 1D:
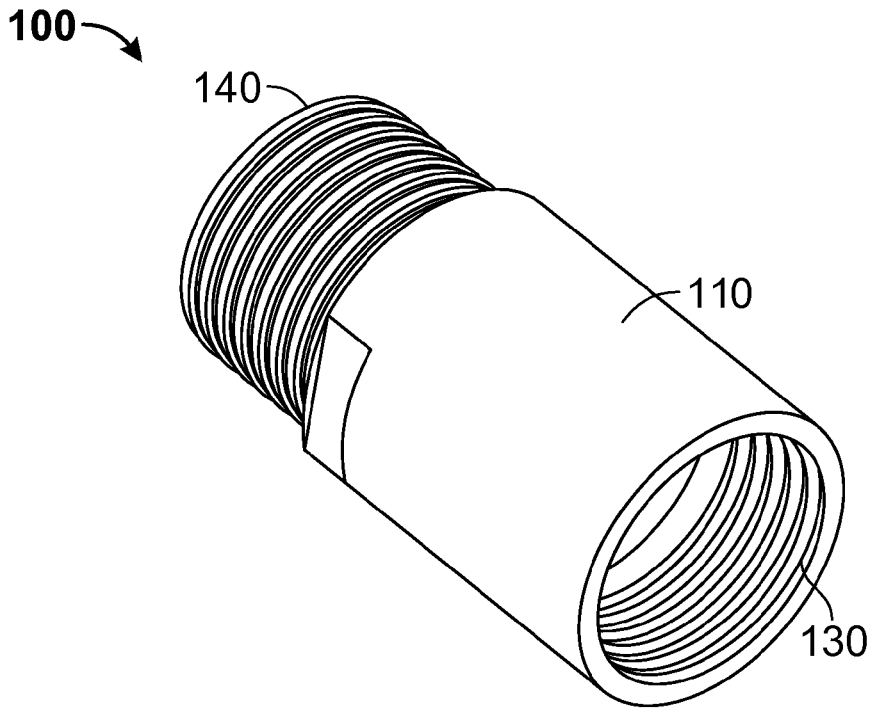
FIG. 1*d* illustrates a perspective view of one implementation embodiment of the flow restrictor of FIG. 1*a;*
Figure 1E:
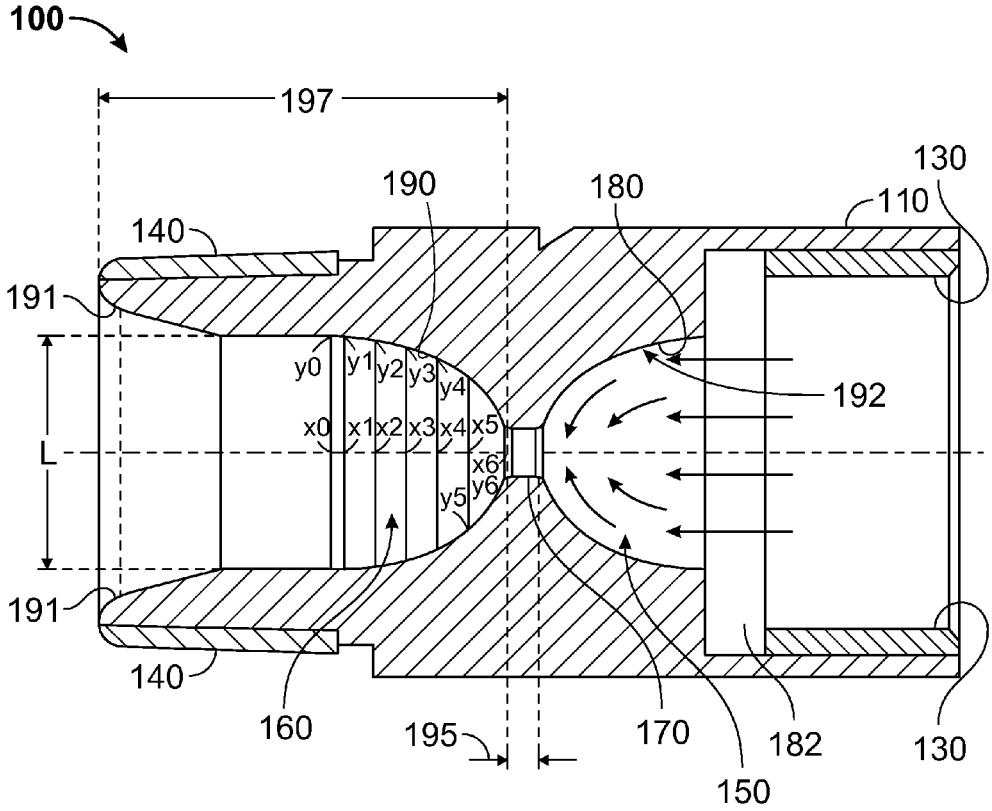
FIG. 1*e* depicts a cross-sectional view of the flow restrictor of FIG. 1*a* taken along the line C-C shown in FIG. 1*c;*

FIG. 1*d* illustrates a perspective view of one implementation of flow restrictor 100. FIG. 1*d* includes references to previously described features of flow restrictor 100. As previously described, flow restrictor 100, as shown in FIG. 1*d*, can be made from any suitable material, including stainless steel, for example. FIG. 1*d* provides one example of an outer design of flow restrictor 100 that is appropriate for flush engagement with a water dispensing fixture such as a shower head and/or shower arm, where aesthetic water conservation devices are desirable.

FIG. 1*e* depicts a cross-sectional view of flow restrictor 100 of FIG. 1*a* taken along the line C-C shown in FIG. 1*c*. FIG. 1*e* includes references to previously described features of flow restrictor 100. FIG. 1*e* and Table I illustrate and detail an ellipse profile 192 (provided in the units of inches) of an embodiment of the present invention.

TABLE I

| Ellipse Profile of FIG. 1e | | | |
|---|---|---|---|
| PT | X | Y (Radius) | L |
| 0 | 0.000 | 0.243 | 0.486 |
| 1 | 0.031 | 0.242 | 0.484 |
| 2 | 0.094 | 0.234 | 0.468 |
| 3 | 0.156 | 0.217 | 0.433 |
| 4 | 0.219 | 0.188 | 0.375 |
| 5 | 0.281 | 0.140 | 0.280 |
| 6 | 0.344 | 0.000 | 0.000 |

Figure 1F:
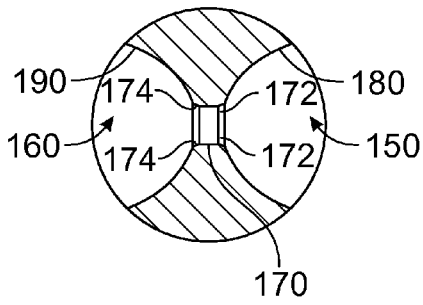
FIG. 1*f* depicts a cross-sectional view of the orifice of the flow restrictor of FIG. 1*a* taken from area B of FIG. 1*b;*

FIG. 1*f* depicts a cross-sectional view of orifice 170 of flow restrictor 100 taken from area B of FIG. 1*b*. FIG. 1*f* includes reference numbers for previously described features of flow restrictor 100. FIG. 1*f* illustrates details of an optional feature of the present invention, wherein orifice 170 has a chamfered inlet 172 and a chamfered outlet 174. Orifice 170 with chamfered inlet 172 and chamfered outlet 174 may reduce noise from the flow of water through the water line by allowing the water flow to pass through orifice 170 without encountering sharp edges, which may account for a squealing sound. The chamfered inlet 172 and chamfered outlet 174 can be chamfered at any angle. For example, the chamfered inlet 172 and the chamfered outlet 174 can be chamfered at an angle of forty-five (45) degrees.

Figure 2A:
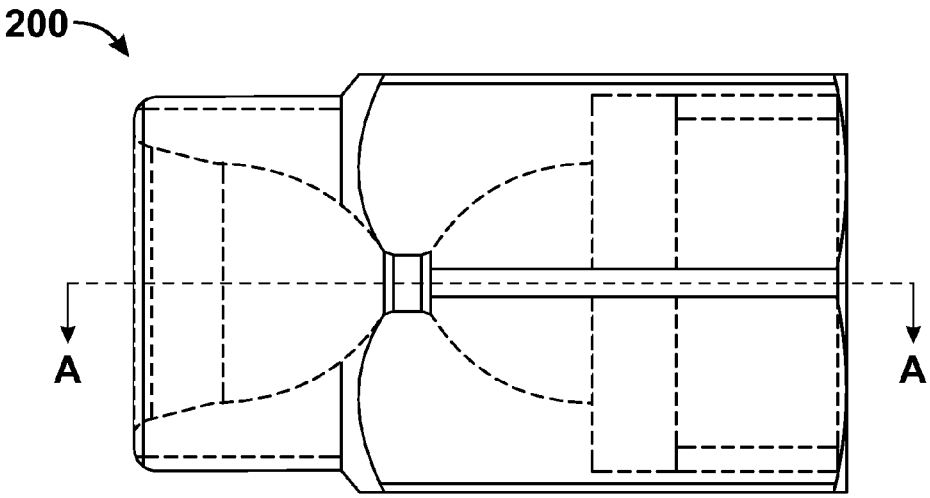
FIGS. 2*a*-2*f* depict an alternative embodiment of a flow restrictor of the present invention.
Figure 2B:
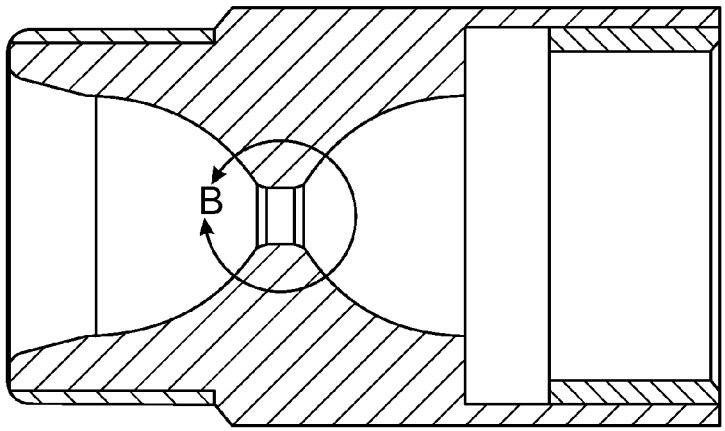
Figure 2C:
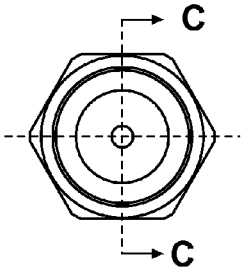
Figure 2D:
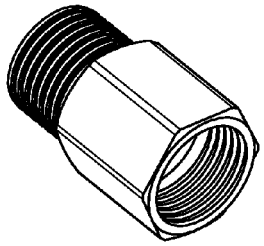

FIGS. 2*a*-2*f* depict an alternative embodiment of a flow restrictor 200 according to the present invention. The figures and references are similar in functionality and configuration to FIGS. 1*a*-1*f*. FIG. 2*d* illustrates an embodiment that can be attached to an angle stop, onto which a flex line is attached, to control the flow of water to a faucet. One advantage of an embodiment that can be attached to an angle stop is the ease of installation at the angle stop as compared to installation at the faucet. FIG. 2*d* also illustrates the outer configuration of flow restrictor 200 which can be used to insert flow restrictor 200 into a water line using a wrench, pliers, or other suitable tool. Some examples of tools include a basin wrench, crescent wrench, open-end wrench, pipe wrench, and water pump pliers. Flow restrictor 200 may also be positioned bi-directionally, which is a further advantage because it eliminates the need for a specific alignment and reduces labor costs associated with misalignment and realignment of the device.

Figure 2E:
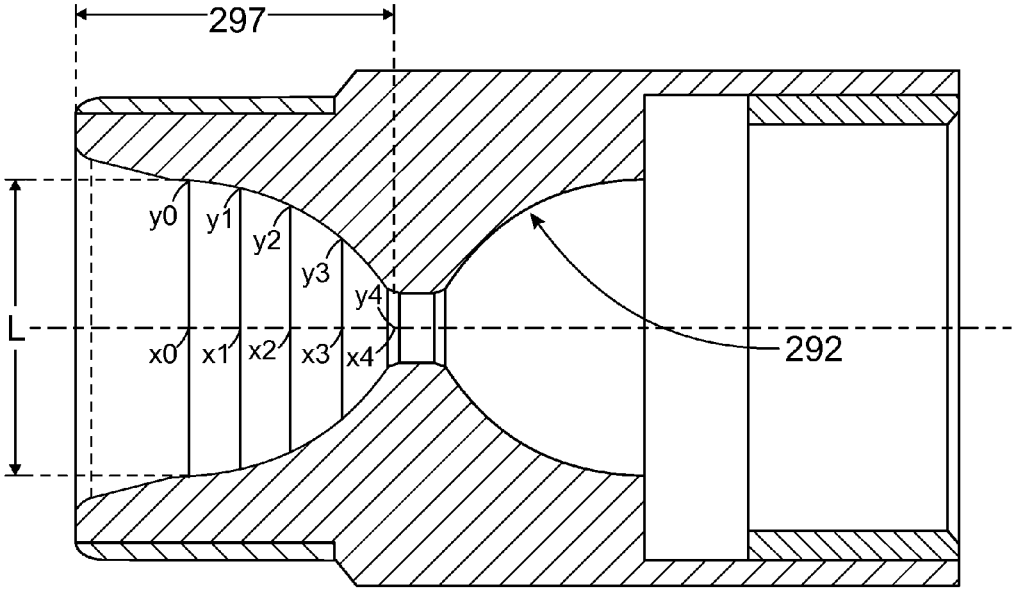
Figure 2F:
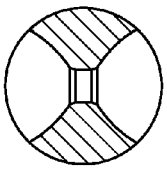

FIG. 2*e* depicts a cross-sectional view of flow restrictor 200 of FIG. 2*a* taken along the line C-C shown in FIG. 2*c*. FIG. 2*e* includes references to previously described features of flow restrictor 200. FIG. 2*e* illustrates exit chamber length 297, which is of shorter length in comparison to exit chamber length 197 of FIG. 1*e*. FIG. 2*e* and Table II illustrate and detail an ellipse profile 292 (provided in the units of inches) of an embodiment of the present invention.

TABLE II

| Ellipse Profile of FIG. 2e | | | |
|---|---|---|---|
| PT | X | Y (Radius) | L |
| 0 | 0.000 | 0.177 | 0.354 |
| 1 | 0.063 | 0.172 | 0.343 |
| 2 | 0.125 | 0.154 | 0.307 |
| 3 | 0.188 | 0.117 | 0.234 |
| 4 | 0.250 | 0.000 | 0.000 |

Figure 3A:
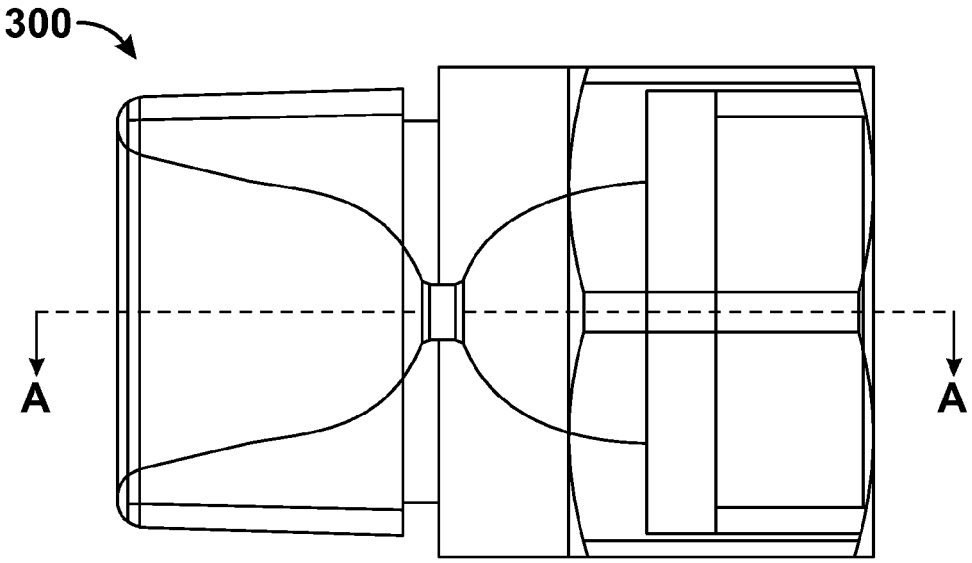
FIGS. 3*a*-3*f* depict an alternative embodiment of a flow restrictor of the present invention.
Figure 3B:
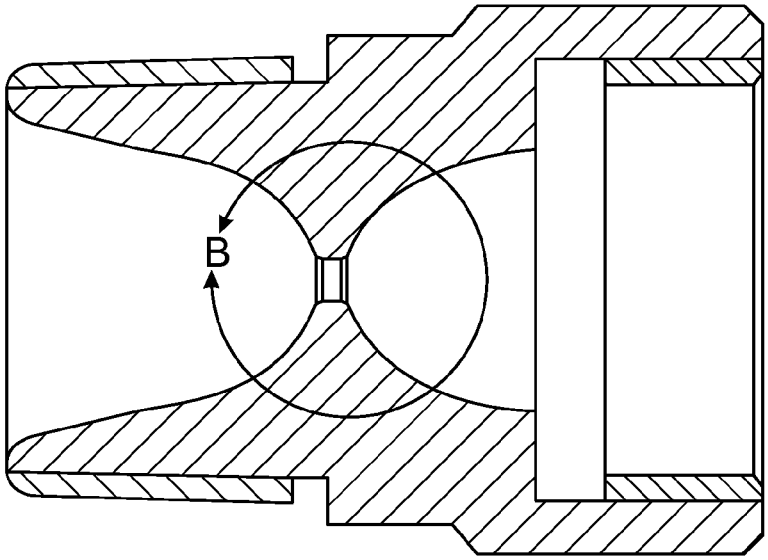
Figure 3C:
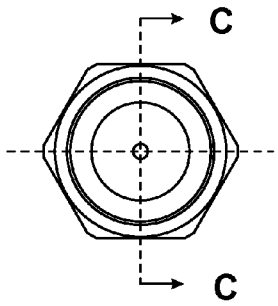
Figure 3D:
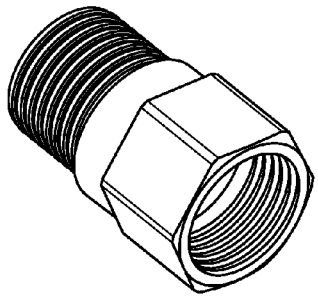

FIGS. 3*a*-3*f* depict an alternative embodiment of a flow restrictor 300 according to the present invention. The figures and references are similar in functionality and configuration to FIGS. 1*a*-1*f*. FIG. 3*d* illustrates an embodiment that can be attached to a faucet shank or hose bib, onto which a supply line is attached, to control the flow of water to a faucet. FIG. 3*d* also illustrates the outer configuration of flow restrictor 300 which can be used to insert flow restrictor 300 into a water line using a wrench, pliers, or other suitable tool. Some examples of tools include a basin wrench, crescent wrench, open-end wrench, pipe wrench, and water pump pliers. Flow restrictor 300 may also be positioned bi-directionally, which eliminates the need for a specific alignment and reduces labor costs associated with misalignment and realignment of the device.

Figure 3E:
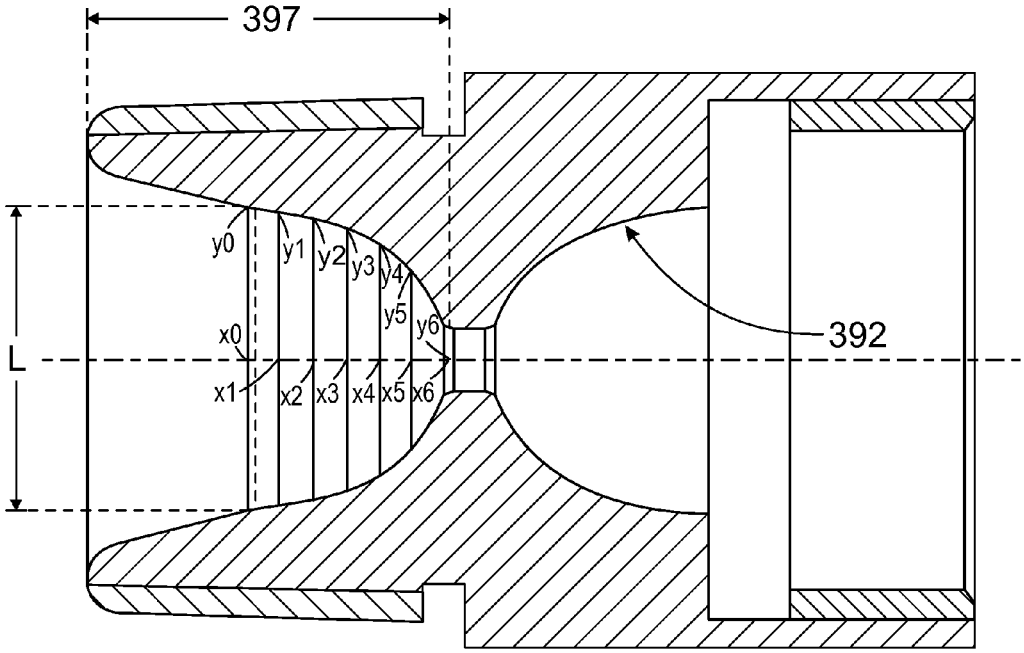
Figure 3F:
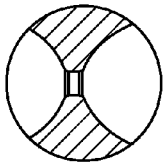

FIG. 3*e* depicts a cross-sectional view of flow restrictor 300 of FIG. 3*a* taken along the line C-C shown in FIG. 3*c*. FIG. 3*e* includes references to previously described features of flow restrictor 300. FIG. 3*e* illustrates exit chamber length 397, which is of shorter length in comparison to exit chamber length 197 of FIG. 1*e*. FIG. 3*e* and Table III illustrate and detail an ellipse profile 392 (provided in the units of inches) of an embodiment of the present invention.

TABLE III

Ellipse Profile of FIG. 3e

| PT | X | Y (Radius) | L |
|---|---|---|---|
| 0 | 0.000 | 0.243 | 0.486 |
| 1 | 0.031 | 0.242 | 0.484 |
| 2 | 0.094 | 0.234 | 0.468 |
| 3 | 0.156 | 0.217 | 0.433 |
| 4 | 0.219 | 0.188 | 0.375 |
| 5 | 0.281 | 0.140 | 0.280 |
| 6 | 0.344 | 0.000 | 0.000 |

FIGS. 4*a*-4*f* generally depict an alternative embodiment of a flow restrictor 400 according to the present invention. Some of the figures and references are similar in functionality and configuration to FIGS. 1*a*-1*f*. Other of the figures and references are different in functionality and configuration to FIGS. 1*a*-1*f* and are described accordingly herein.

Figure 4A:
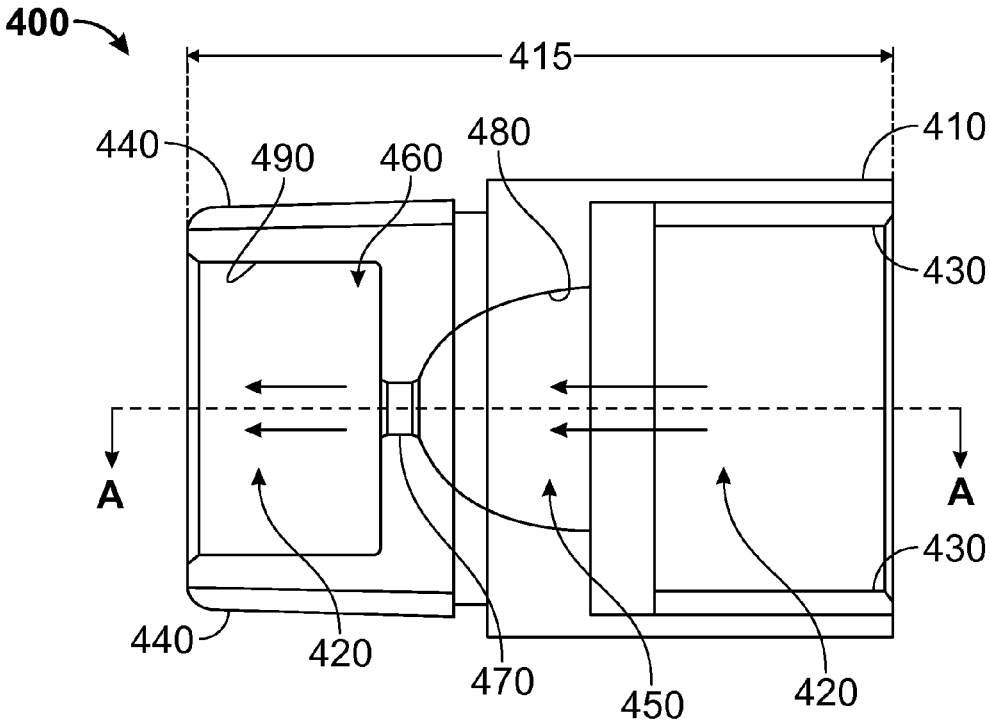
FIG. 4*a* provides an interior view of an alternative embodiment of a flow restrictor of the present invention.
Figure 4B:
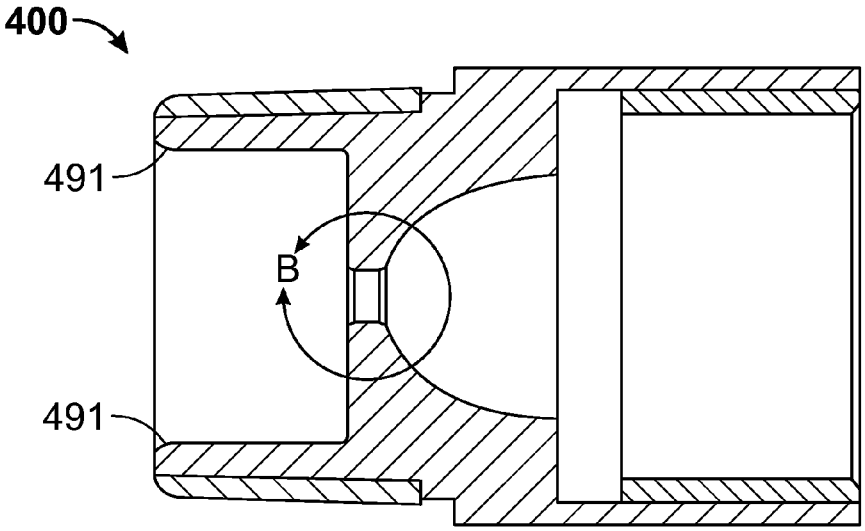
FIG. 4*b* depicts a cross-sectional view of the flow restrictor of FIG. 4*a* taken along the line A-A shown in FIG. 4*a;*
Figure 4C:
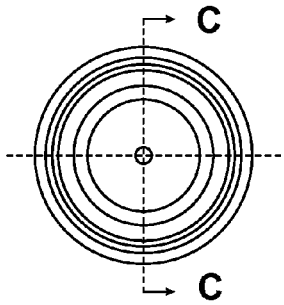
FIG. 4*c* illustrates a top view of the flow restrictor of FIG. 4*a;*

As shown in FIG. 4*a*, flow restrictor 400 includes an upstream water receiving chamber 450 with elliptically converging interior configuration 480 approaching orifice 470. Flow restrictor 400 further includes a flat-based cylindrical interior configuration 490 departing orifice 470. This flat-based cylindrical chamber 460 helps to reduce water noise through the water line approaching a shower head when flow restrictor 400 is inserted into a water line in such a configuration.

Flat-based cylindrical chamber 460 departing orifice 470 limits flow restrictor 400 to uni-directional installation, such that flat-based cylindrical chamber 460 acts as an exit chamber. The exit chamber length 497 (as shown in FIG. 4*e*) of flow restrictor 400 is shortened for production cost savings and aesthetics as compared to the exit chamber length 197 of flow restrictor 100. For example, for otherwise comparable dimensions and length of flow restrictors 400, 100, a flow restrictor length 415 of 1.315 inches has an exit chamber length 497 of 0.375 inches, while a flow restrictor length 115 of 1.796 inches has an exit chamber length 197 of 0.852 inches. Alternative designs of the exit chamber are also within the scope of the present invention. For example, a flow restrictor according to the present invention may include a conical exit chamber.

Figure 4D:
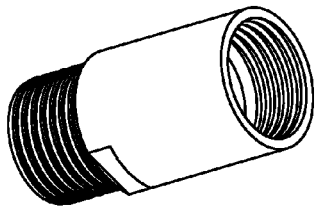
FIG. 4*d* illustrates a perspective view of one implementation embodiment of the flow restrictor of FIG. 4*a;*
Figure 4E:
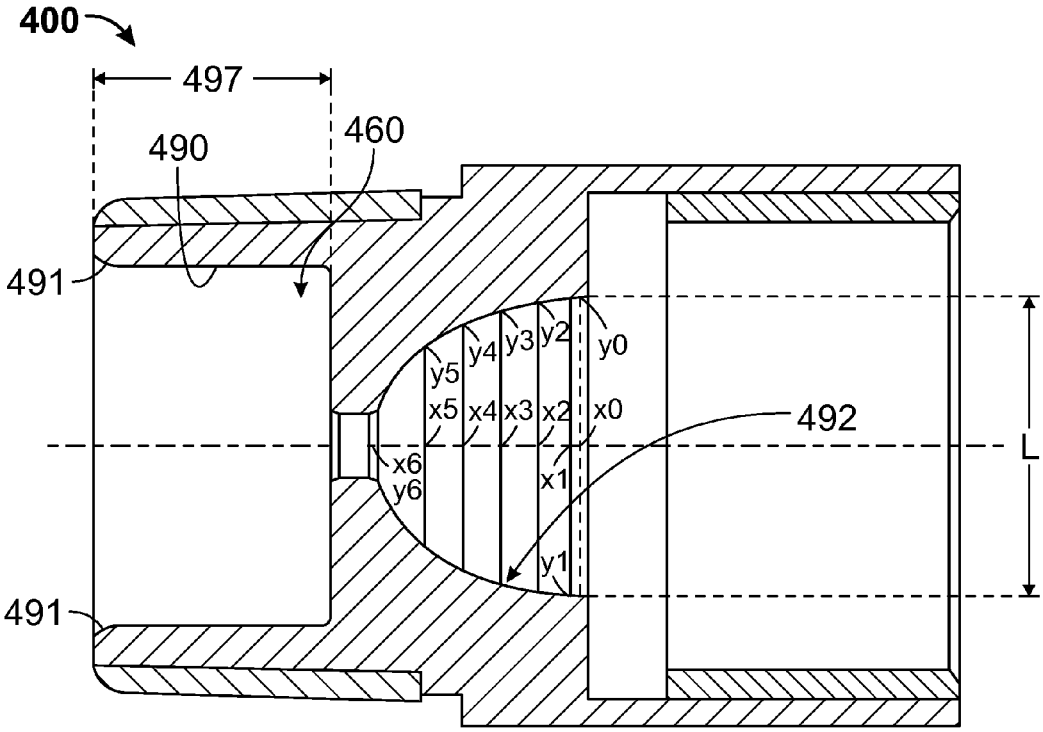
FIG. 4*e* depicts a cross-sectional view of the flow restrictor of FIG. 4*a* taken along the line C-C shown in FIG. 4*c*.
Figure 4F:
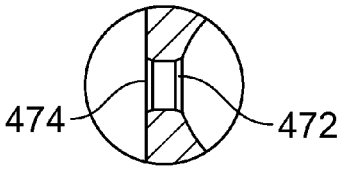
FIG. 4*f* depicts a cross-sectional view of the orifice of the flow restrictor of FIG. 4*a* taken from area B of FIG. 4*b*.

FIG. 4*d* illustrates an embodiment that can be attached, for example, to a shower head, shower arm, and/or shower supply line. FIG. 4*e* depicts a cross-sectional view of flow restrictor 400 of FIG. 4*a* taken along the line C-C shown in FIG. 4*c*. FIG. 4*e* includes references to previously referenced features of flow restrictor 400. FIG. 4*e* and Table IV illustrate and detail an ellipse profile 492 (provided in the units of inches) of an embodiment of the present invention.

TABLE IV

Ellipse Profile of FIG. 4e

| PT | X | Y (Radius) | L |
|---|---|---|---|
| 0 | 0.000 | 0.243 | 0.486 |
| 1 | 0.031 | 0.242 | 0.484 |
| 2 | 0.094 | 0.234 | 0.468 |
| 3 | 0.156 | 0.217 | 0.433 |
| 4 | 0.219 | 0.188 | 0.375 |
| 5 | 0.281 | 0.140 | 0.280 |
| 6 | 0.344 | 0.000 | 0.000 |

A summary of test results from the embodiments depicted in FIGS. 4*a*-4*f* is provided in Table B below.

TABLE B

Test Results

| Test | Shower Head | Results | Actual Flow Rate (GPM) | Savings (GPM) |
|---|---|---|---|---|
| 1 | Standard Delta shower head rated 2.5 GPM (actual flow rate 2.635 GPM at 60 PSI) with 1.5 GPM flow restrictor of the present invention in place | An acceptable shower, no noise issues | 1.5 | 1.135 |
| 2 | Standard Delta shower head rated 2.5 GPM (actual flow rate 2.635 GPM at 60 PSI) with 2.0 GPM flow restrictor of the present invention in place | A good shower, no noise issues | 1.875 | .75 |
| 3 | Standard Oxygenics shower head rated 2.5 GPM with 1.5 GPM flow restrictor of the present invention in place | An acceptable shower, no noise issues | 1.5 | 1 |
| 4 | Standard Oxygenics shower head rated 2.5 GPM with 2.0 GPM flow restrictor of the present invention in place | Good shower, no noise issues | 1.781 | .719 |
| 5 | Unbranded Water Conservation shower head rated 1.75 GPM with 1.5 GPM flow restrictor of the present invention in place | An acceptable shower, no noise issues | 1.406 | .344 |

While the specification has been described in detail with respect to specific embodiments of the invention, it will be appreciated that those skilled in the art, upon attaining an understanding of the foregoing, may readily conceive of alterations to, variations of, and equivalents to these embodiments. These and other modifications and variations to the present invention may be practiced by those of ordinary skill in the art, without departing from the spirit and scope of the present invention, which is more particularly set forth in the appended claims. Furthermore, those of ordinary skill in the art will appreciate that the foregoing description is by way of example only, and is not intended to limit the invention. Thus, it is intended that the present subject matter covers such modifications and variations as come within the scope of the appended claims and their equivalents.

The invention claimed is:

1. A fluid flow restrictor for insertion into a fluid line connected to a fluid dispensing fixture, said restrictor comprising:

an in-line restrictor body having a longitudinal flow passageway, and an upstream coupling and a downstream coupling for coupling said body into said fluid line, said body defining (i) an upstream fluid receiving chamber, (ii) a downstream fluid passing chamber and (iii) an orifice of selectable restrictive size between said chambers to limit the flow of fluid in said passageway;

wherein said upstream fluid receiving chamber comprises an elliptically converging interior configuration approaching said orifice.

2. A fluid flow restrictor according to claim 1, wherein said downstream fluid passing chamber comprises an elliptically diverging interior configuration departing said orifice.

3. A fluid flow restrictor according to claim 1, wherein said downstream fluid passing chamber is a flat-based cylindrical chamber departing said orifice.

4. A fluid flow restrictor according to claim 1, wherein the elliptically converging interior configuration of said upstream fluid receiving chamber creates and accommodates substantially turbulent fluid flow in said upstream fluid receiving chamber; and wherein the substantially turbulent fluid flow assists with dissolving particulate matter in said upstream fluid receiving chamber through a washing mechanism.

5. A fluid flow restrictor according to claim 1, wherein the elliptically converging interior configuration of said upstream fluid receiving chamber creates and accommodates substantially turbulent fluid flow in said upstream fluid receiving chamber; and wherein the substantially turbulent fluid flow assists with the prevention of particulate matter from becoming lodged in said orifice.

6. A fluid flow restrictor according to claim 1, wherein the flow of fluid is turbulently minimized through said passageway.

7. A fluid flow restrictor according to claim 1, wherein the fluid flow passing into the downstream fluid passing chamber is substantially non-turbulent.

8. A fluid flow restrictor according to claim 1, wherein the fluid is water.

9. A fluid flow restrictor according to claim 1, wherein said orifice further comprises a chamfered inlet and a chamfered outlet.

10. A fluid flow restrictor according to claim 9, wherein the chamfered inlet and the chamfered outlet are chamfered at an angle of forty-five (45) degrees.

11. A fluid flow restrictor according to claim 1, wherein the in-line restrictor body material is selected from the group consisting of stainless steel, no-lead brass, aluminum, copper, polyvinyl chloride (PVC), polymer, ceramic and composite.

12. A fluid flow restrictor according to claim 2, wherein the fluid flow restrictor may optionally be positioned bi-directionally into the fluid line.

13. A fluid flow restrictor for insertion into a fluid line connected to a fluid dispensing fixture, said restrictor comprising:

an in-line restrictor body having a longitudinal flow passageway, and an upstream coupling and a downstream coupling for coupling said body into said fluid line, said body defining (i) an upstream fluid receiving chamber, (ii) a downstream fluid passing chamber and (iii) an orifice of selectable restrictive size between said chambers to limit the flow of fluid in said passageway;

wherein said upstream fluid receiving chamber comprises an elliptically converging interior configuration approaching said orifice; and wherein the design of the elliptically converging interior configuration approaching said orifice increases fluid turbulence within said upstream fluid receiving chamber.

14. A fluid flow restrictor according to claim 13, wherein said downstream fluid passing chamber comprises an elliptically diverging interior configuration departing said orifice.

15. A fluid flow restrictor according to claim 13, wherein said downstream fluid passing chamber is a flat-based cylindrical chamber departing said orifice.

16. A fluid flow restrictor according to claim 13, wherein the elliptically converging interior configuration of said upstream fluid receiving chamber creates and accommodates substantially turbulent fluid flow in said upstream fluid receiving chamber; and wherein the substantially turbulent fluid flow assists with dissolving particulate matter in said upstream fluid receiving chamber through a washing mechanism.

17. A fluid flow restrictor according to claim 13, wherein the elliptically converging interior configuration of said upstream fluid receiving chamber creates and accommodates substantially turbulent fluid flow in said upstream fluid receiving chamber; and wherein the substantially turbulent fluid flow assists with the prevention of particulate matter from becoming lodged in said orifice.

18. A fluid flow restrictor according to claim 13, wherein the flow of fluid is turbulently minimized through said passageway.

19. A fluid flow restrictor according to claim 13, wherein the fluid flow passing into the downstream fluid passing chamber is substantially non-turbulent.

20. A fluid flow restrictor according to claim 14, wherein the fluid flow restrictor may optionally be positioned bi-directionally into the fluid line.

* * * * *

UNITED STATES PATENT AND TRADEMARK OFFICE

CERTIFICATE OF CORRECTION

PATENT NO. : 8,646,486 B2
APPLICATION NO. : 13/570197
DATED : February 11, 2014
INVENTOR(S) : John Schommer It is certified that error appears in the above-identified patent and that said Letters Patent is hereby corrected as shown below:

On Title page 2, at Item (56) References Cited, U.S. PATENT DOCUMENTS, please insert --2012/0073043 A1 2012-03-29 Jaworski et al.--. (Should be inserted in the listing of patents under 2009/0065061 A1.)

Signed and Sealed this
Twenty-ninth Day of April, 2014

Michelle K. Lee

Michelle K. Lee
*Deputy Director of the United States Patent and Trademark Office*